US006225900B1

(12) United States Patent
Keon et al.

(10) Patent No.: US 6,225,900 B1
(45) Date of Patent: May 1, 2001

(54) BUOYANT ACCESSORY DEVICE FOR SPAS

(76) Inventors: David Keon; Susan Keon, both of 31740 Homewood, Farmington Hills, MI (US) 48334

( * ) Notice: Subject to any disclaimer, the term of this patent is extended or adjusted under 35 U.S.C. 154(b) by 0 days.

(21) Appl. No.: 08/821,954

(22) Filed: Mar. 24, 1997

(51) Int. Cl.[7] ..... G08B 1/08

(52) U.S. Cl. ..... 340/539; 340/692; 340/384.1; 381/311; 381/310

(58) Field of Search ..... 374/156, 208, 374/109, 136; 340/539, 692, 286.13, 328, 425.1, 384.1; 455/344; 381/300, 310, 311

(56) References Cited

U.S. PATENT DOCUMENTS

| | | | | |
|---|---|---|---|---|
| 4,030,361 | | 6/1977 | Fortune | 73/353 |
| 4,503,563 | | 3/1985 | Johnson | 455/351 |
| 5,099,220 | * | 3/1992 | Camarota | 340/388 |
| 5,152,610 | | 10/1992 | Hallett | 374/156 |
| 5,169,236 | | 12/1992 | Iest | 374/156 |
| 5,369,796 | * | 11/1994 | Kung | 455/344 |
| 5,600,730 | * | 2/1997 | Kenning et al. | 381/77 |
| 5,604,478 | * | 2/1997 | Grady et al. | 340/330 |

* cited by examiner

*Primary Examiner*—Daryl Pope

(57) ABSTRACT

A buoyant accessory device 10 for use in a spa 100 and in conjunction with a remote piece of audio equipment 200 to produce a stereophonic effect within the spa 100. The device 10 comprises a buoyant housing member 20 containing a receiver unit 15 which is coupled in a wireless fashion to a remote transmitting unit 16 directly connected to the remote piece of audio equipment 200.

10 Claims, 2 Drawing Sheets

BUOYANT ACCESSORY DEVICE FOR SPAS

CROSS REFERENCE TO RELATED APPLICATIONS

Figure 1:
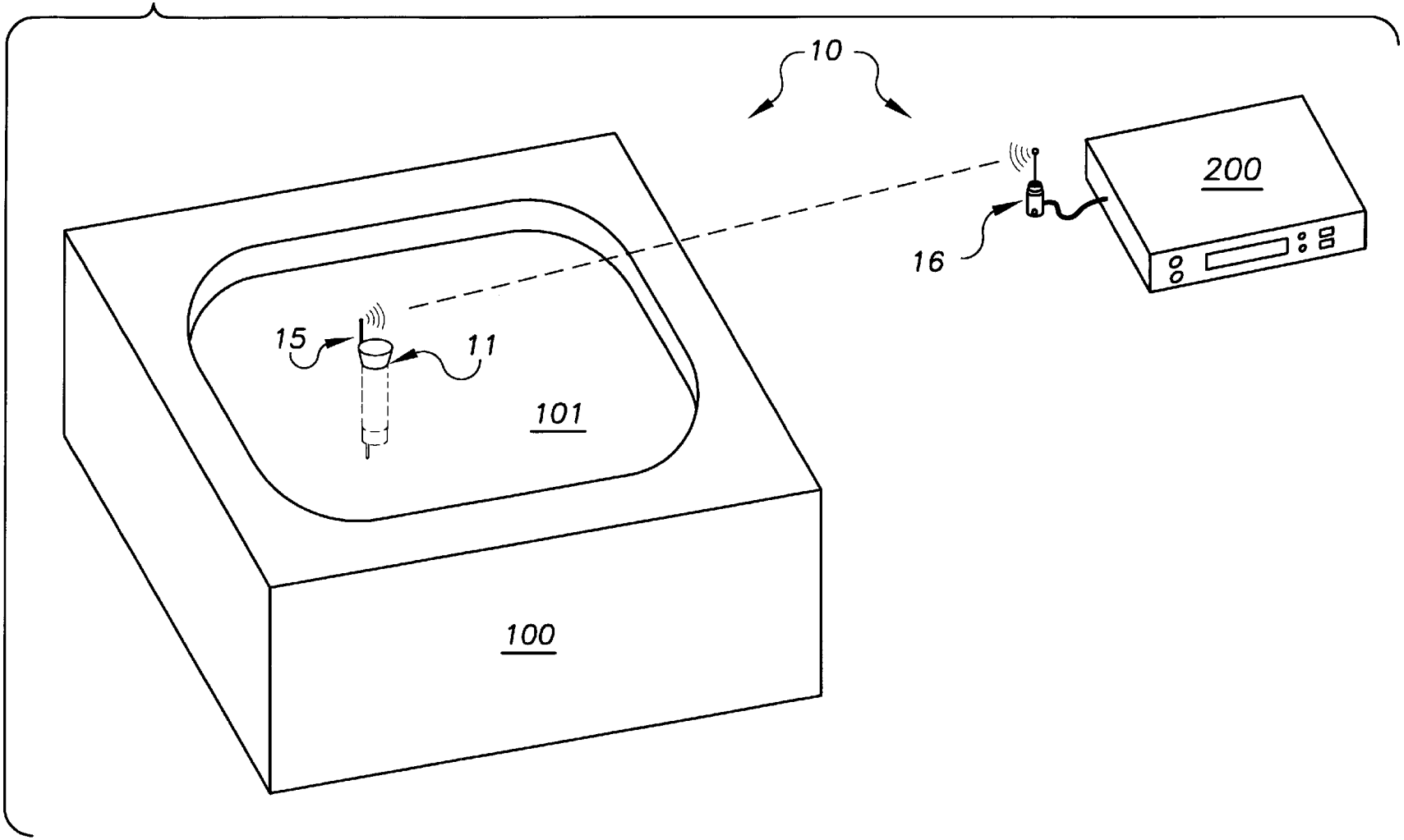

This is a continuation of original application Ser. No. 08/821,954.

BACKGROUND OF THE INVENTION

1. Field of the Invention

The present invention relates to the field of spa accessories in general, and in particular to a buoyant time and temperature device for use in spas wherein the device also includes an FM receiver that is connected in a wireless fashion to a nearby FM transmitter.

2. Description of Related Art

As can be seen by reference to the following U.S. Pat. Nos. 4,030,361; 4,503,563; 5,152,610; and 5,169,236; the prior art is replete with myriad and diverse buoyant spa accessory devices which serve multiple functions, such as an illumination source, a timing mechanism, a temperature recorder, a radio, etc.

While all of the aforementioned prior art constructions are more than adequate for the basic purpose and function for which they have been specifically designed, none of the aforementioned patented constructions combine an FM receiver with a buoyant diverse art device wherein the FM receiver is connected in a wireless fashion to a nearby FM transmitter to produce a stereo effect to a user sitting in a spa, hot tub or Jacuzzi.

As anyone who has even the most basic understanding of electronics is aware, electrical devices in general, should never be placed in close proximity to a body of water in which a person has any portion of their anatomy submerged. Unfortunately, with human nature being what it is, many people exhibit behavior which flirts with disaster in their quest for personal satisfaction by placing audio and audio-visual electronic devices in close proximity to hot tubs, spas and the like so that they may be entertained while relaxing therein.

As a consequence of the foregoing situation, there has existed a longstanding need for a new type of floating spa accessory that will not only provide the user with desirable information while relaxing in the spa, such as the actual time, temperature and a preselected duration of time that they should remain in this heated environment, but also with a means of listening to music in a safe stereophonic wireless fashion, and the provision of such a construction is a stated objective of the present invention.

SUMMARY OF THE INVENTION

Briefly stated, the buoyant accessory device for spas that forms the basis of the present invention comprises a buoyant housing unit, a power unit, a clock unit, a temperature unit, an FM receiver unit, and a remote FM transmitting unit.

As will be explained in greater detail further on in the specification, the power unit, clock unit, temperature unit, and FM receiver unit are all contained within the buoyant housing unit which floats in a spa or the like. The remote FM transmitting unit is operatively connected to a remote FM signal generating device which is connected in a wireless fashion to the FM receiver unit.

Furthermore, as the buoyant accessory device is moved around the spa or the like by the forced circulation of the water, the stereo effect produced by the FM receiver unit and the remote FM signal generating unit will vary producing a rather unusual audio effect for the user.

BRIEF DESCRIPTION OF THE SEVERAL VIEW OF THE DRAWING

Figure 2:
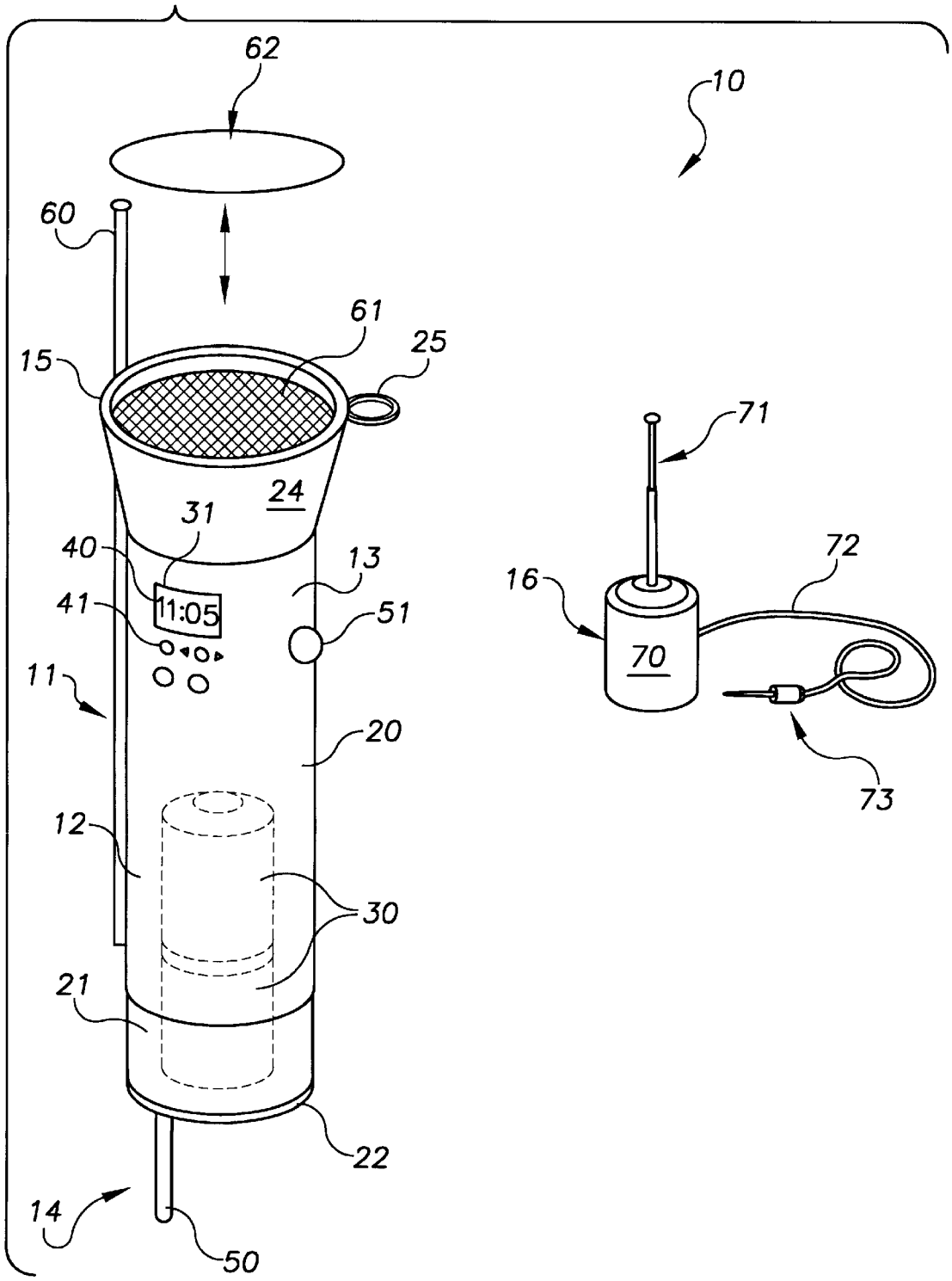

These and other attributes of the invention will become more clear upon a thorough study of the following description of the best mode for carrying out the invention, particularly when reviewed in conjunction with the drawings, wherein:

FIG. 1 is a perspective view of the buoyant accessory device that forms the basis of the present invention in use; and FIG. 2 is an isolated perspective view of the two major components which form the buoyant accessory device.

DETAILED DESCRIPTION OF THE INVENTION

As can be seen by reference to the drawings, and in particularly to FIG. 1, the buoyant accessory device that forms the basis of the present invention is designated generally by the reference number 10. The device 10 comprises in general a housing unit 11, a power source unit 12, a clock unit 13, a temperature unit 14, an FM receiver unit 15 and a remote FM transmitting unit 16. These units will now be described in seriatim fashion.

As shown in FIG. 2, the housing unit 11 comprises an elongated generally cylindrical water impermeable housing member 20 fabricated from a buoyant material, wherein the lower portion of the housing member 20 is provided with a threaded waterproof closure element 21 which provides access to the interior of the housing member 20.

The power source unit 12 comprises one or more replaceable battery members 30 which are dimensioned to be received within the lower portion of the housing member 20. The battery members 30 provide ballast to maintain the housing member 20 in a upright disposition when the housing member 20 is partially submerged. Furthermore, in the event that the weight of the battery members 30 are insufficient to maintain the housing member 20 in an upright position, this invention also contemplates incorporating a weighted element 22 into the base of the closure element 21.

The clock unit 13 comprises a conventional electronic clock member 40 provided with a plurality of push button controls 41 for programming the clock member 40 relative to the actual time as well as either an elapsed time or alarm function in a well recognized manner.

The temperature unit 14 comprises a thermal probe member 50 which projects outwardly and downwardly from the housing member 20. The outputs of both the temperature unit 14 and the clock unit 13 are connected by a microprocessor (not shown) to a LED display 31 which is responsive to a three-way switch 51 which will govern whether the actual time, elapsed time, or water temperature will appear on the LED display 50.

Still referring to FIG. 2, it can be seen that the FM receiver unit 15 comprises a receiver antennae 60 and a receiver speaker 61 which are mounted in the upper portion 24 of the housing member 20. The upper portion 24 of the housing member 20 is also provided with a waterproof sound transmitting membrane 62 which covers the receiver speaker 61.

In addition, the upper portion 24 of the housing member 20 may optionally be provided with a tether loop 25 that may be used to tether the housing member 20 at a general location within a spa receptacle 101 for reasons that will be explained presently.

Turning now to FIGS. 1 and 2, it can be seen that the remote FM transmitting unit 16 comprises an FM transmitting member 70 provided with a transmitting antennae 71 and a power cord 72 having an electrical coupler 73. The coupler 73 is connected to a conventional piece of audio equipment 200 such that the output of the audio equipment 200 is generated both from the audio equipment per se and from the remote FM transmitting unit 16 to the FM receiving unit 15 to produce a stereophonic effect to a user sitting in the spa 100.

As a consequence of the foregoing arrangement, a user of the device 10 will be able to safely listen to music in a stereo mode while within the spa 100 and will also be able to have immediate data readings regarding the actual time, the time spent within the spa, and the temperature of the water.

Furthermore, the tether loop 25 may be employed with a tether (not shown) to generally restrict the housing member 20 to an area within the spa receptacle 101 which produces the best audio effects in conjunction with the remotely located audio equipment 200.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

What is claimed is:

1. In combination with a conventional audio signal producing device, a buoyant accessory device for use in spas comprising:

a buoyant housing member;

a remote transmitting unit in electrical communication with the audio signal producing device, said transmitting unit including means for transmitting radio waves in response to audio signals received from the signal producing device;

a power source unit received within said housing member; and a receiver unit within said housing member for producing sound in response to the radio waves transmitted by said remote transmitting unit;

whereby said housing member can be safely used in water to produce sound corresponding to the audio signals produced by the remote audio signal producing device.

2. The accessory device according to claim 1 wherein said housing member is elongated having upper and lower ends with a speaker mounted on said upper end, said speaker in communication with said receiver unit for audibilizing radio waves transmitted by said remote transmitting unit.

3. The accessory device according to claim 2 wherein said housing member further comprises a weighted element removably coupled to the lower end of said housing member to maintain said housing member in an upright position when placed in water whereby the speaker is above the water surface.

4. The accessory device according to claim 2 wherein said housing member includes a waterproof sound-transmitting membrane covering the speaker unit.

5. The accessory device according to claim 2 wherein said housing member also includes a clock in communication with an LED display.

6. The accessory device according to claim 5 wherein said housing member also includes a temperature sensing means in communication with said LED display for visibly displaying a water temperature on said housing.

7. The accessory device according to claim 6 further comprising a tether loop attached to the housing which may be secured to a fixed tether within the spa to limit the movement of said housing within the spa.

8. The device according to claim 6 wherein said clock and said temperature sensing means are connected to said LED display via a microprocessor that is responsive to a three-way switch for selectively displaying either an actual time, an elapsed time or a water temperature.

9. The device according to claim 8 further comprising:

a transmitting member connected to said audio signal producing device, said transmitting member having a transmitting antenna for transmitting a signal to said receiver unit; said audio producing device further including a second speaker whereby sound is emitted through said housing member speaker and said audio signal producing device speaker to produce a stereophonic effect.

10. The device according to claim 9 wherein batteries are received within said housing and positioned in the lower end thereof whereby said batteries further ballast said housing member in an upright position when placed in water.

* * * * *